United States Patent [19]

Koenig et al.

[11] 4,231,747

[45] Nov. 4, 1980

[54] SHRINKPROOFING WOOL WITH COPPER SALTS OF CARBOXYLIC ACIDS

[75] Inventors: Nathan H. Koenig, Albany; Mendel Friedman, Moraga, both of Calif.

[73] Assignee: The United States of America as represented by the Secretary of Agriculture, Washington, D.C.

[21] Appl. No.: 57,858

[22] Filed: Jul. 16, 1979

[51] Int. Cl.[3] ..... D06M 13/00; D06M 3/02; D06M 13/20; D06M 13/12

[52] U.S. Cl. ..... 8/127.6; 8/127.5; 8/128 R

[58] Field of Search ..... 8/128 R, 127.5, 127.6

[56] References Cited

U.S. PATENT DOCUMENTS

| | | | |
|---|---|---|---|
| 3,097,052 | 7/1963 | Koenig | 8/128 R |
| 3,433,576 | 3/1969 | Tesoro | 8/128 R |
| 3,867,095 | 2/1975 | Koenig | 8/128 R |
| 3,894,839 | 7/1975 | Marmer et al. | 8/128 R |
| 3,927,969 | 12/1975 | Koenig et al. | 8/128 R |
| 4,074,005 | 2/1978 | Moore et al. | 428/378 |

OTHER PUBLICATIONS

Textile Res. Jour., "Shrinkproofing of Wool with Cupric Ammonium Sulfite Solutions," vol. 33, 1963, pp. 578–579, McPhee.

"Textile Res. Jour.," vol. 48, p. 525, Kantouch et al.

*Primary Examiner*—Joseph L. Schofer
*Assistant Examiner*—Herbert J. Lilling
*Attorney, Agent, or Firm*—M. Howard Silverstein; David G. McConnell; Theodore J. Leitereg

[57] ABSTRACT

Proteinaceous fibers are modified by first contacting the fibers with an aqueous solution of a cupric salt of a carboxylic acid containing from 2–18 carbon atoms and then contacting the so-treated fibers with a hot, semipolar, water-miscible organic solvent. The modified fibers exhibit increased resistance to shrinkage.

13 Claims, No Drawings

SHRINKPROOFING WOOL WITH COPPER SALTS OF CARBOXYLIC ACIDS

BACKGROUND OF THE INVENTION

1. Field of the Invention

This invention relates broadly to the chemical modification of proteinaceous fibers, especially wool. In particular, the invention concerns and has as its prime object the provision of novel processes for shrinkproofing such fibers. Further objects of the invention will be evident from the following description wherein parts and percentages are by weight unless otherwise specified.

2. Description of the Prior Art

Although wool is a very useful fiber, it is often desirable to improve its properties for particular applications by chemically modifying it. For example, in U.S. Pat. No. 3,927,969, Koenig et al., have shown that wool can be reacted with zinc acetate in the presence of a polar, highboiling solvent to yield a modified wool having increased resistance to insects. Further, Koenig et al. (U.S. Pat. No. 3,867,095) have modified wool to improve its resistance to laundering shrinkage by a two-step process in which the wool is successively reacted with a cyclic acid anhydride and zinc acetate. Wool treated separately, however, either with zinc acetate or a cyclic anhydride, did not exhibit shrink resistant properties.

It is also known that the felting or shrinkage of wool can be reduced by treating wool with cupric ammonium sulfite solutions (McPhee, *Textile Research Journal*, Vol. 33, pages 578–579 (1963)). To this end, wool is contacted with an aqueous solution of copper sulfate and sodium sulfite, and ammonium hydroxide is added to pH 10.1. It is notable, however, that copper sulfate, in the absence of sulfite and ammonium hydroxide, does not impart shrink-resistant properties to wool (Kantouch et al., *Textile Research Journal*, Vol. 48, page 525 (1978)).

SUMMARY OF THE INVENTION

Proteinaceous fibers including wool can be modified by treating the fibers with an aqueous solution of a copper salt of a carboxylic acid containing from 2–18 carbon atoms. Then, the fibers are heated in a semipolar, water miscible organic solvent.

A primary advantage of the invention is that it yields modified wool which is much more resistant to shrinkage when laundered than normal (unmodified) wool.

Another advantage of the invention is that the improvement is essentially permanent; the treated materials do not lose their new properties after long use or cleaning, but retain these properties for the life of the material.

A further advantage of the invention is that the modified wool retains its flexibility so that it is useful for all the conventional applications as in fabricating garments, blankets, etc.

DESCRIPTION OF THE PREFERRED EMBODIMENTS

In the following description, emphasis is directed, by way of illustration and not limitation, to wool fibers. In its broad ambit the invention is applicable to improving the shrink-proofing properties of proteinaceous fibers of all kinds including wool, mohair, silk, animal hair, and fibers made from proteins such as casein, zein, peanut protein, etc.

In the first step of the process of the invention, wool is contacted with an aqueous solution containing a cupric salt of a carboxylic acid containing 2–18 carbon atoms. Usually, the temperature of the solution is about 70°–100° C., and contact between the wool and the solution is maintained for about 10–120 minutes. As a general rule, the temperature and duration of the reaction, as well as the proportions of the reactants, should be sufficient to enhance the shrinkage properties of the wool without deleterious effects on the woolen fibers. Approximately 5–20 parts of the aqueous cupric salt solution should be employed per part of wool. The concentration of cupric salt in the aqueous solution should be such that 0.1–1.0 parts of cupric salt are used per part of wool, preferably, 0.5–1.0 parts of cupric salt per part of wool.

As mentioned above, a cupric salt of a carboxylic acid containing 2–18 carbon atoms is used in the present method. The following list illustrates by example the cupric salts that find utility in the invention: cupric acetate, cupric propionate, cupric butanoate, cupric pentanoate, cupric hexanoate, cupric heptanoate, cupric octanoate, cupric nonanoate, cupric decanoate, cupric undecanoate, cupric dodecanoate, cupric pentadecanoate, cupric octadecanoate, cupric hexadecanoate, cupric heptadecanoate, cupric oleate, cupric linoleate, and the like, and their branchedchain counterparts.

Also included within the scope of the invention are cupric salts of dicarboxylic acids and cupric salts of carboxylic acids containing substituents such as halogen, hydroxyl, ether groups, etc., on the hydrocarbon residues.

Further included within the invention is the generation in situ of a cupric salt of an organic acid as described above. To this end a source of cupric ions such as cupric carbonate, cupric borate, cupric phosphate, or the like, is mixed with an appropriate organic acid, such as acetic acid, propionic acid, and so forth, which corresponds to the desired salt. The cupric salt of the organic acid is formed in solution and the wool is contacted therewith.

It is also within the compass of the invention to add a conventional wetting agent to the aforementioned aqueous cupric salt solution to enhance the wettability of the wool. Useful for this purpose are Triton×100 (manufactured by Rohm and Haas Co.), Igepal DM-530 (General Aniline and Film Corp.), Surfonic N-95 (Jefferson Chemical Co.), etc.

Following the treatment of the wool with the cupric salt, the fibers are separated from the aqueous solution and placed in a semipolar, water miscible organic solvent. In general, the temperature of the solvent should be about 70°–100° C. (usually about the boiling temperature of the solvent) during the period of contact with the wool, which is generally about 3–10 minutes. Approximately 10–20 parts of solvent are employed per one part of woolen fiber. It may be desirable to perform several operations wherein treated wool is contacted with the solvent.

The semipolar, water-miscible organic solvent has the characteristics that it dissolves cupric ions and is soluble in water. Furthermore, the organic solvent should have a dielectric constant of about 12–25. As the organic solvent one may use ethanol, n-propanol, isopropanol, isobutanol, tert-butanol, 2-butanone, 2-pentanone, methylisopropyl ketone, and the like.

It should be noted that contact with a hot organic solvent as described above is a critical feature of the process of the invention. If the aforementioned step is omitted, shrink-resistance is substantially reduced.

After treatment in accordance with the invention, the chemically-modified wool is preferably treated to remove excess reactants. Thus, the wool may be treated as by wringing, passage through squeeze rolls, centrifugation, etc., to remove excess reagents. Such mechanical treatment may also be applied to the woolen fibers immediately after contact thereof with the aqueous cupric salt solution in the first step of the instant method. Thus, the woolen fibers can be separated from this aqueous solution and treated by wringing, passage through squeeze rolls, centrifugation, etc.

Water removal from the wet fibers can be accomplished further by heating in air, hot rollers, heating in vacuum, infrared lamps, microwave drying, azeotropic distillation, contact with desiccants, blowing in air, and so forth. Thus, the fibers after treatment with hot organic solvent and removal of excess reagents are subjected to any of the above-listed methods to complete the drying of the wool.

The primary advantage of the invention is that the modified wool is more resistant to laundering shrinkage. The tendency of wool to shrink when subjected to washing in aqueous media has long been a deterrent to the more widespread use of wool. An advantage of the invention is that it yields modified wools which have a decreased tendency to shrink when subjected to washing with conventional soap and water or detergent and water formulations or when dry-cleaned.

Although the properties of the products of the invention indicate actual chemical combination of the wool with the cupric salt of the organic acid has taken place, it is not known for certain what is the mechanism involved. It is believed that the cupric ion reacts with amino, imidazole, hydroxyl, phenolic, and carboxyl groups of wool. In addition, cross-linking and oxidation reactions also may occur. It may be, however, that other reactions occur and it is not intended to limit the invention to any theoretical basis.

It is to be noted that the reaction in accordance with the invention does not impair the wool fiber for its intended purpose, that is, for producing woven or knitted textiles, garments, etc. The process of the invention may be applied to wool in the form of fibers, as such, or in the form of threads, yarns, slivers, rovings, knitted or woven goods, felts, etc. The wool textiles may be of all-wool composition or blends of wool with other textile fibers such as cotton, rayon, polyester, polyamide, acrylic, etc.

The success of our invention is quite surprising and unexpected. Other cupric salts such as cupric chloride and cupric sulfate do not render wool shrinkproof when employed in the instant process. Furthermore, nickel acetate, zinc acetate, and calcium acetate are also ineffective.

EXAMPLES

The invention is further demonstrated by the following illustrative examples.

The wool used in the experiments set forth below was scoured, undyed wool, exhaustively extracted with trichloroethylene, followed by ethanol. The fabric was cut into 8 cm. circular samples for the treatments. All weight increases are given on a dry wool basis although the wool was equilibrated to normal moisture content prior to treatment.

In all runs except those of Example 1, 1 drop of a 20% aqueous solution of Triton×100 was added to the aqueous solution. In Example 1, the final treatment was with ethanol boiled over in a Soxhlet apparatus. In all succeeding examples, the final treatment was made by boiling the fabric sample or samples (maximum 4) with 100 ml of ethanol in a 600 ml beaker.

Cupric carbonate was in the form of the basic carbonate monohydrate $CuCO_3.Cu(OH)_2.H_2O$.

The shrinkage tests were conducted as follows: Measured fabric samples, including an untreated wool control, were violently agitated in an "Accelerator" at 1.780 rpm for 2 minutes at 39°–40° C. with 200 ml of 0.5% aqueous sodium oleate solution. After this laundering operation, the samples were remeasured to determine area shrinkage.

EXAMPLE 1

A. Cupric acetate monohydrate (0.7 g) was dissolved in 8.0 ml of water at a temperature of about 80° C. in a Petri dish. A 1.252 g sample of woolen fabric had a dry weight of 1.126 g, calculated by a moisture factor. The sample was immersed in the cupric acetate solution; the dish was covered and heated in an over at 110° C. for 60 minutes. The wool was treated twice with 15 ml portions of ethanol at 78° C. and then placed in a Soxhlet apparatus and treated with boiling ethanol for 16 hours. The woolen fabric was removed from the ethanol and dried in an oven at 110° C. for 1.5 hours. The fabric was green and weighed 1.205 g while still dry.

B. The procedure in A was repeated except that cupric acetate was omitted.

As a control untreated wool was subjected to shrinkage tests, as were the fabrics of Runs A and B above. The results are summarized below:

| Run | Treatment | Weight increase (%) | Area shrinkage (%) |
|---|---|---|---|
| A | Cupric acetate | 7.0 | 0 |
| B | Water | −1.0 | 35 |
| Control | None | 0 | 49 |

EXAMPLE 2

C. The procedure of Example 1, Run A was followed with the following exceptions: One drop of 20% Triton X100 was added to the aqueous acetate solution and the fabric was boiled in a beaker with 100 ml of ethanol for 2 hours instead of the Soxhlet treatment.

D. The above procedure was repeated using 0.03 g of cupric acetate.

The fabrics of C and D were subjected to shrinkage tests; untreated wool was employed as a control. The results are summarized in the following table.

| Run | Treatment | Weight increase (%) | Area shrinkage (%) |
|---|---|---|---|
| C | cupric acetate (0.70 g) | 6.1 | 3 |
| D | cupric acetate (0.30 g) | 3.6 | 19 |
| Control | none | 0 | 43 |

EXAMPLE 3

E. The procedure of Example 1, Run A was followed except that the fabric was boiled in 100 ml of ethanol for 15 minutes.

F. The procedure of E above was followed with cupric chloride substituted for cupric acetate.

G. The procedure of E above was followed except that cupric sulfate was used in place of cupric acetate.

H. Again, the procedure of E was repeated except that nickel (II) acetate was substituted for cupric acetate.

Untreated wool was used as a control again and was subjected to shrinkage tests together with the fabrics of Runs E–H. The results are summarized below.

| Run | Treatment | Weight increase (%) | Area shrinkage (%) |
|---|---|---|---|
| E | cupric acetate | 5.6 | 4 |
| F* | cupric chloride | 4.5 | 18 |
| G* | cupric sulfate | 4.9 | 32 |
| H* | nickel (II) acetate | 1.5 | 43 |
| Control | None | 0 | 43 |

*Not in accordance with the invention but provided for comparative purposes.

EXAMPLE 4

I. The procedure of Example 1, Run A, was followed except that the fabric was boiled in 100 ml ethanol for 10 minutes instead of the Soxhlet treatment.

J. The above procedure was repeated substituting boiling isopropanol (twice, 15 ml portions) for ethanol prior to boiling in 100 ml ethanol for 10 minutes.

K. Again, the procedure of I above was followed with butanone in place of ethanol prior to boiling in 100 ml ethanol.

L. The procedure in I above was repeated except that cold water was employed in place of ethanol prior to boiling in 100 ml ethanol.

M. Procedure I was employed with boiling water substituted for ethanol prior to boiling in 100 ml ethanol.

The samples of Runs I–M were tesed for shrinkage along with untreated wool as a control. The results are summarized below.

| Run | Treatment (solvent) | Weight increase (%) | Area shrinkage (%) |
|---|---|---|---|
| I | ethanol | 5.8 | 3 |
| J | isopropanol | 7.0 | 4 |
| K | butanone | 9.7 | 0 |
| L* | cold water | 1.9 | 18 |
| M* | hot water | 3.5 | 14 |
| Controls | none | 0 | 43,44 |

*Not in accordance with the invention, but provided for purposes of comparison.

EXAMPLE 5

N. Cupric carbonate (0.84 g) and glacial acetic acid (0.84 g) were mixed with 8.0 ml of water in a Petri dish and heated to form a solution, and a 1.3 g sample of woolen fabric was immersed therein. The dish was placed in an oven at 110° C. for 60 minutes. The sample was removed from the solution and treated twice with 15 ml portions of ethanol at 78° C. and with 100 ml of boiling ethanol for 10 minutes. The fabric was dried in an oven at 110° C. for 1.5 hours.

The Run N fabric and an untreated control sample were treated for shrinkage; the results are summarized in the following table.

| Run | | Weight increase (%) | Area shrinkage (%) |
|---|---|---|---|
| N | Cupric acetate (in situ) | 6.3 | 4 |
| Control | none | 0 | 51 |

After the shrinkage test, fabric N contained 5.1% copper, by atomic absorption analysis.

EXAMPLE 6

O. The procedure described in Run N of Example 5 was followed except that 1.04 g of proprionic acid was used in place of acetic acid.

An untreated woolen fabric sample and the fabric of Run O were tested for shrinkage. The results are tabulated below.

| Run | Treatment | Weight increase (%) | Area shrinkage (%) |
|---|---|---|---|
| 0 | Cupric propionate (in situ) | 9.3 | 1.4 |
| Control | none | 0 | 51 |

After the shrinkage test fabric O contained 6.8% copper.

Having thus described our invention, we claim:

1. A process for shrinkproofing proteinaceous fibers, which comprises (a) contacting the fibers with an aqueous solution of a cupric salt of a carboxylic acid containing from 2 to 18 carbon atoms at a temperature and concentration and for a period of time sufficient to enhance the shrinkage properties of the fibers, and (b) contacting the fibers of step a with a semipolar, water miscible organic solvent at a temperature and in an amount and for a period of time sufficient to shrinkproof the fibers.

2. The process of claim 1 wherein the fibers are contacted with the aqueous solution of said cupric salt at a temperature of about 70°–100° c. for a period of about 10–20 minutes.

3. The process of claim 1 wherein one part of the fibers are contacted with 5–20 parts of the aqueous solution of said cupric salt, said aqueous solution containing 0.1–1.0 parts of said cupric salt per part of fibers.

4. The process of claim 1 wherein the fibers are contacted with said organic solvent at a temperature of about 70°–100° C. and for a period of about 3–10 minutes.

5. The process of claim 1 wherein the fibers are contacted with said organic solvent in the proportion of one part fibers per 10–20 parts of organic solvent.

6. The process of claim 1 wherein said organic solvent has a dielectric constant of about 12–25.

7. The process of claim 1 wherein the proteinaceous fibers are woolen fibers.

8. The process of claim 1 wherein the cupric salt is cupric acetate.

9. The process of claim 1 wherein the cupric salt is cupric propionate.

10. The process of claim 1 wherein the organic solvent is ethanol.

11. The process of claim 1 wherein the organic solvent is isopropanol.

12. The process of claim 1 wherein the organic solvent is isobutanone.

13. The process of claim 1 wherein the cupric salt of the carboxylic acid is generated in situ by mixing a source of cupric ions and the carboxylic acid.

* * * * *